US007591026B2

(12) United States Patent
Kronenberger

(10) Patent No.: US 7,591,026 B2
(45) Date of Patent: Sep. 22, 2009

(54) HEADWEAR ITEM WITH ASSOCIATED SHAPING ITEM

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 345 days.

(21) Appl. No.: 11/248,535

(22) Filed: Oct. 12, 2005

(65) Prior Publication Data

US 2007/0079425 A1 Apr. 12, 2007

(51) Int. Cl.
*A42B 1/24* (2006.01)

(52) U.S. Cl. ..... 2/209.13

(58) Field of Classification Search ..... 2/175.2, 2/0.3, 0.5, 195.6, 195.7, 209.11–209.13; 40/329; 132/57.1, 60, 63.1, 101; 351/155; 223/12, 14, 84; 446/27
See application file for complete search history.

(56) References Cited

U.S. PATENT DOCUMENTS 1,168,989 A * 1/1916 Zitka ..... 223/84
3,858,769 A * 1/1975 Billingslea, Jr. ..... 223/84
5,003,639 A * 4/1991 White ..... 2/46
5,634,575 A 6/1997 Scharrenberg
5,647,064 A 7/1997 Whittaker
5,908,146 A 6/1999 Levin
5,991,927 A 11/1999 Barbaccia
6,076,192 A * 6/2000 Kronenberger ..... 2/195.6
6,370,696 B1 * 4/2002 Kronenberger ..... 2/175.1
6,510,972 B1 1/2003 Briskey
6,655,558 B2 * 12/2003 Lawrence ..... 223/14
6,694,526 B1 * 2/2004 Tate ..... 2/209.12
6,755,329 B2 * 6/2004 Thompson ..... 223/14

* cited by examiner

*Primary Examiner*—Katherine Moran
(74) *Attorney, Agent, or Firm*—Wood, Phillips, Katz, Clark & Mortimer

(57) ABSTRACT

A method of using wearable items. The method includes the step of: providing a headwear item having a crown that engages a wearer's head and a rim/bill projecting angularly away from the crown; providing a second item; attaching the second item to the rim/bill; separating the second item from the rim/bill; and wearing the second item with the second item separated from the headwear item on at least one of: a) the wearer's limb or hair; or b) a clothing item worn by the wearer.

8 Claims, 4 Drawing Sheets

HEADWEAR ITEM WITH ASSOCIATED SHAPING ITEM

BACKGROUND OF THE INVENTION

1. Field of the Invention

This invention relates to headwear and, more particularly, to a headwear item having a projecting rim/bill.

2. Background Art

Myriad headwear designs are currently offered with a forwardly projecting rim/bill. This rim/bill configuration is common to visors and baseball-style caps.

Baseball-style caps have become increasingly popular and stylish in many circles. Baseball-style caps are desired for their comfort as well as the function they perform in shielding a wearer's face from sun and the elements.

These caps are adorned in many different ways. The most common adornment is that associated with athletic teams at all professional and amateur levels. These caps are also commonly used to promote activities, events, institutions, products, etc. As a result, those businesses offering this type of headwear must generally display a wide range of products, differing in terms of type, quality and ornamentation.

With so many competitors in the headwear industry, it is important that displays be devised to highlight particularly the ornamentation on these caps. Further, these displays are preferably set up so that users can conveniently try on the headwear for purposes of look and feel.

Ideally, baseball-style caps are displayed in the same general starting state with the rim/bill slightly bowed into an inverted "U" shape. However, users often have different preferences, particularly in terms of the shape of the rim/bill. Typically, the rims/bills are made from a material that can be shaped, normally by forcibly bending the rim/bill material. One popular shape is a more squared, inverted "U" shape achieved by producing spaced bend lines extending in a fore-and-aft direction. Prospective purchasers often will shape the rim/bill to their liking at the point of purchase and check the appearance thereof by wearing the headwear.

The assignee herein currently offers a baseball-style cap with a highly formable rim/bill. One form of this headwear piece is shown in U.S. Pat. No. 6,076,192.

As noted above, it is undesirable that a point of purchase display have headwear pieces with rims/bills that are bent into different configurations. While the rims/bills are made to exhibit good shape memory, there is generally a residual deformation after the rim/bill is re-shaped. To avoid this problem, it is known to provide systems with shaping components for the rim/bill. These shaping systems come in many different forms and generally are designed to produce a fairly consistent, downwardly opening, arcuate shape for the rim/bill.

Generally, the shaping systems are designed either to be recovered by the purveyor of the headwear or remain with the headwear after sale. While the shaping systems are effective in maintaining rims/bills consistently in a desired starting shape, each type has some inherent drawbacks.

If the shaping system is designed to be recovered, the establishment that sells the headwear piece must devise a system to remove and handle the same for re-use. If the shaping systems are retained by the headwear purchasers, it is normally intended that the shaping systems will be discarded. Consequently, the shaping system becomes a single use item. As a result, the shaping systems are designed to be cheaply manufactured and, as a result, may not perform as effectively as desired. Additionally, there is an inherent inconvenience having components that must be disposed of in an appropriate manner by the ultimate consumer.

SUMMARY OF THE INVENTION

In one form, the invention is directed to a method of using wearable items. The method includes the steps of: providing a headwear item having a crown that engages a wearer's head and a rim/bill projecting angularly away from the crown; providing a second item; attaching the second item to the rim/bill; separating the second item from the rim/bill; and wearing the second item with the second item separated from the headwear item on at least one of: a) the wearer's limb or hair; or b) a clothing item worn by the wearer.

In one form, the step of attaching the second item to the rim/bill involves attaching the second item to the rim/bill so that the second item maintains a shape of the rim/bill.

In one form, the rim/bill has spaced side edges and the step of attaching the second item to the rim/bill involves engaging the rim/bill at the space side edges so that the second item causes the rim/bill to bow between the spaced side edges.

The step of attaching the second item to the rim/bill may involve changing a configuration of the second item to vary bowing of the rim/bill between the side edges.

The step of providing a second item may involve providing an elongate second item that can be reconfigured and independently maintained in a plurality of different shapes.

The method may further include the step of reconfiguring the second item after the second item is separated from the rim/bill.

In one form, the step of reconfiguring the second item involves reconfiguring the second item into a curved shape, with the step of wearing the second item involving wearing the second item after the second item is reconfigured, around a limb of the wearer.

The step of providing a headwear item may involve providing a headwear item with information thereon relating to a first subject matter. The step of providing a second item involve may involve providing a second item with information related to the first subject matter.

In one form, the step of providing a second item involves providing a second item having two elongate elements that extend between the spaced side edges of the rim/bill and a web spanning between the two elongate elements.

The step of providing a headwear item may further involve providing a headwear item wherein the rim/bill has a core made from expanded foam.

The invention is further directed to the combination of a headwear item and a second item. The headwear item has a crown to engage a wearer's head and a rim/bill projecting away from the crown. The second item is attached to the rim/bill. The second item is separable from the rim/bill and wearable by a user apart from the headwear piece on at least one of: a) a user's limb or hair; or b) a clothing item worn by a wearer.

In one form, the rim/bill has spaced side edges and with the second item attached to the rim/bill, the second item engages the spaced side edges and causes the rim/bill to bow between the spaced side edges.

In one form, with the second item attached to the rim/bill, the second item maintains a shape of the rim/bill.

The second item may have a changeable configuration such that bowing of the rim/bill between the spaced side edges can be selectively changed.

In one form, the second item is elongate and can be reconfigured and independently maintained in a plurality of different shapes.

The second item may be reconfigurable into a curved shape that is wearable as a bracelet or anklet.

In one form, the second item has U-shaped ends within which the side edges nest with the second item attached to the rim/bill.

In one form, there is information on the headwear item related to a first subject matter and there is information on the second item that relates to the first subject matter.

The second item may consist of two elongate elements with a web spanning between the elongate elements.

In one form, the rim/bill has spaced side edges and the two elongate elements extend fully between the spaced side edges.

In one form, the two elongate elements each has spaced ends which are U-shaped and in which the spaced side edges of the rim/bill nest.

The rim/bill may have a core made from expanded foam.

In one form, the expanded foam is in a sheet form.

The invention is further directed to the combination of a headwear item having a crown to engage a wearer's head and a rim/bill projecting away from the crown, and a second item attached to the rim/bill. The second item is reconfigurable and independently maintainable in a plurality of different shapes. The rim/bill has spaced edges. The second item engages the rim/bill and in first and second different configurations is capable of maintaining the rim/bill bowed in first and second different shapes.

The second item may be fully separable from the headwear item.

In one form, the second item has a length and a substantially uniform width.

In one form, substantially the entire width engages the rim/bill substantially fully between the spaced side edges.

In one form, the second item has U-shaped ends within which the spaced side edges of the rim/bill nest.

In one form, there is information on the headwear item related to a first subject matter and there is information on the second item that relates to the first subject matter.

In one form, the second item has two elongate elements with a web spanning between the elongate elements.

In one form, the crown has a core made from expanded foam.

The expanded foam may be in a sheet form.

In one form, the second item is separable from the headwear item and is wearable on at least one of: a) the wearer's limb or hair; or b) a clothing item worn by the wearer.

DETAILED DESCRIPTION OF THE DRAWINGS

Figure 1:
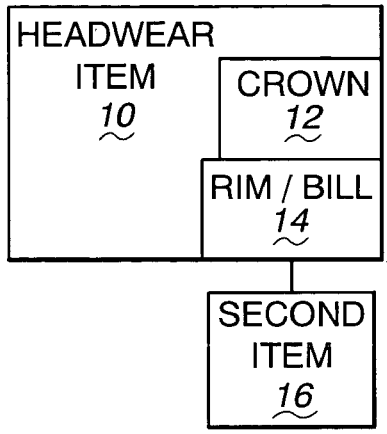
FIG. 1 is a schematic representation of the inventive combination of a headwear item with a rim/bill projecting from a crown, and a second item attachable to the rim/bill and separable therefrom to be used apart from the rim/bill.

In FIG. 1, a headwear item, according to the present invention, is shown at 10 and is design to be worn by a user in a first manner. The headwear item 10 may have virtually any configuration to be usable with the invention, so long as the headwear item 10 has a crown 12 that engages a wearer's head and a rim/bill 14 projecting angularly away from the crown 12. A second item 16 is provided in combination with the headwear item 10 and is attachable to the rim/bill 14. The second item 16 is separable from the headwear item 10 and is usable to be worn by a user in any of a number of different manners, different that the above-noted first manner, as hereinafter described.

Specific forms of the headwear item 10 and second item 16 are shown in FIGS. 2-11. The headwear item 10 depicted is in the form of a baseball-style cap with an inverted, cup-shaped configuration for the crown 12. The rim/bill 14 projects angularly away from the crown 12 at the front region thereof.

In this embodiment, the crown 12 is made from a plurality of triangularly-shaped gores 18 with matched edges 20 joined and maintained together by lines of stitching 22.

The rim/bill 14 may be made from virtually a limitless number of different materials and in many different manners. Typically, and in this case, the rim/bill 14 has a bowed shape between spaced side edges 24, 26. In a normal, relaxed state, the bow of the rim/bill 14 produces an inverted, curved, "U" shape between the side edges 24, 26.

Regardless of the construction of the rim/bill 14, it is desirable, as it is with all baseball-style caps, that the rim/bill 14 be reshapeable. This may be done by creasing the rim/bill 14 or by forcibly compressing it between the sides to cause the bowing to change to thereby produce different shapes.

Figure 3:
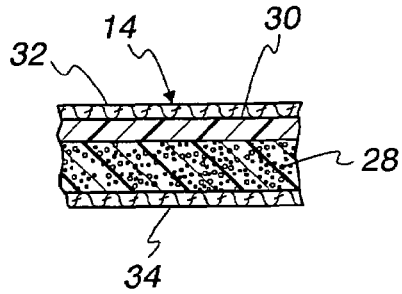
FIG. 3 is an enlarged, cross-sectional view of the rim/bill along lines 3-3 of FIG. 2.

One rim/bill construction that is particularly suitable for the present invention is that shown in U.S. Pat. No. 6,076,192, commonly assigned herewith. The disclosure in that patent is incorporated herein by reference. Generally, as shown in FIG. 3 herein, the rim/bill 14 in U.S. Pat. No. 6,076,192 consists of a core layer 28 that is made from expanded foam material. As described in that patent, one exemplary composition is expanded, closed cell, polyvinyl chloride. The core layer 28 is formed as a sheet corresponding to the shape of the rim/bill 14 as viewed from a plan perspective. A skin layer 30 overlies the outside of the core layer 28. The core and skin layers 28, 30 are sandwiched between upper and lower fabric sheets 32, 34, respectively.

This particular rim/bill construction lends itself to reconfiguration of the rim/bill 14. That is, the bowing of the rim/bill 14 between the side edges 24, 26 can be readily varied without a significant amount of compressive force application thereto upon the edges 24, 26.

According to the invention, the second item 16 is usable to maintain the rim/bill 14 in different selected shapes. More specifically, it is preferred that the second item 16 be configured to change the particular bowed shape of the rim/bill 14.

The second item 16 has an elongate body 36 with spaced ends 38, 40. Two elongate wire elements 42, 44 extend between the ends 38, 40. The wire elements 42, 44 are bendable and made from a material that can be reconfigured and independently maintained in virtually a limitless number of different selected shapes with the second item separated both from the first item and a user and without any external force applied to the second item.

A layer 46, as from cloth, surrounds the elongate wire elements 42, 44 so as to define a web 48 therebetween. More particularly, as shown clearly in FIG. 6, the cloth layer 46 is wrapped around the wire elements 42, 44, either partially or fully along the length thereof, and has ends 50, 52 doubled back under the web 48. Lines of stitching 54, 56 are respectively formed through the web 48 and cloth end 50, and web 48 and cloth end 52 so that spaced sleeves 58, 60 are formed by the cloth layer 46 respectively around the wire elements 42, 44.

A V-shaped clip 62 is crimped at each of the ends 38, 40. The clips 62 produce a neat appearance and have tangs 64 spaced along the width W thereof so that the clips 62 firmly grip the cloth layer 46 at the ends of 38, 40 of the body 36, to maintain the elongate wire elements 42, 44 spaced apart a predetermined distance. Through this arrangement, the web 48 is lightly stretched between the wire elements 42, 44 along substantially the entire length of the elongate body 36. At the same time, the clips 62 produce a neat appearance at the ends 38, 40. Consequently, the body 36 has a substantially uniform width WI, corresponding approximately to the width W for the clip 62, between opposite edges 66, 68 on the body 36.

The ends 38, 40 of the body 36 are return bent to define U "shapes" thereat forming receptacles 70, 72, opening generally towards each other.

The second item 16 can be attached to the rim/bill 14 in a number of different manners. As one example, the second item 16, between the ends 38, 40, can be pre-formed with a bowed shape corresponding to that desired for the rim/bill 14. The bottom surface 74 of the second item 16 can then be placed facially against an upwardly facing surface 76 on the rim/bill 14, after which the ends 38, 40 can be bent around the side edges 24, 26 and under the rim/bill 14.

Figure 4:
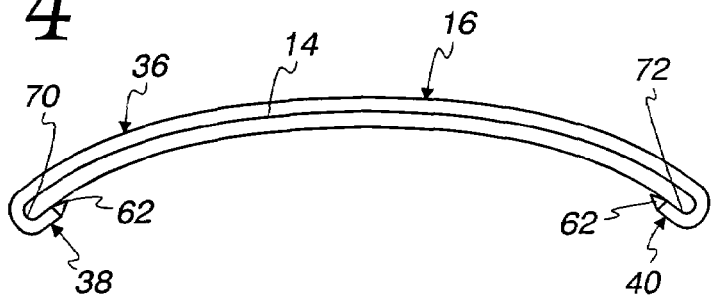
FIG. 4 is a fragmentary, front elevation view of the rim/bill in FIG. 2 with the second item thereon and maintaining the rim/bill in a first bowed shape.
Figure 5:
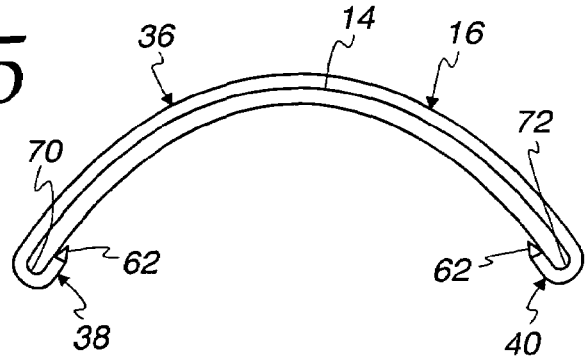
FIG. 5 is a view as in FIG. 4 wherein the second item is reconfigured to maintain the rim/bill in a second bowed shape that is different than that in FIG. 4.
Figure 6:
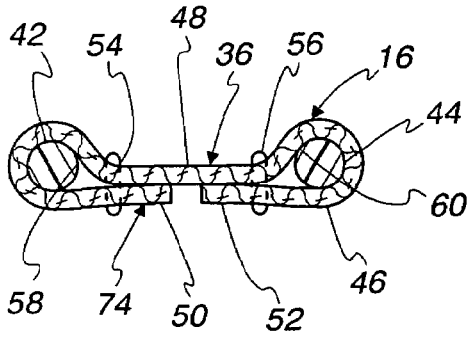
FIG. 6 is an enlarged, cross-sectional view of the second item taken along lines 6-6 of FIG. 2.
Figure 7:
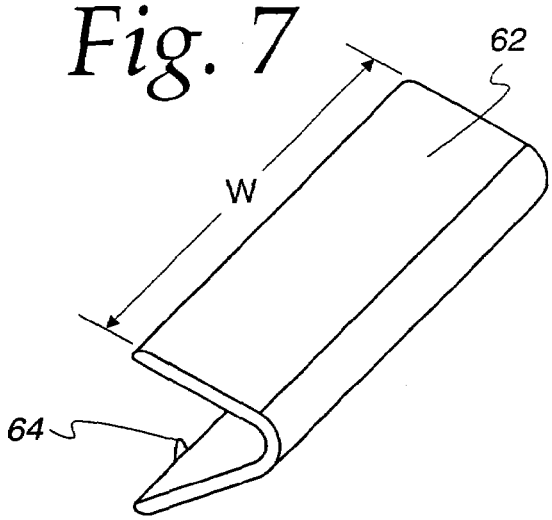
FIG. 7 is an enlarged, perspective view of a clip that is attached to a free end of the second item, with the clip configured preparatory to assembly.
Figure 8:
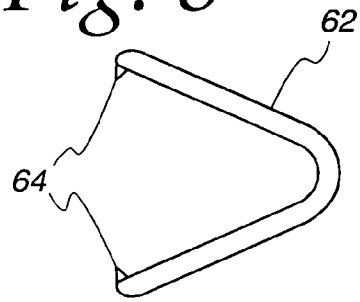
FIG. 8 is an enlarged, side elevation view of the clip in FIG. 7.
Figure 9:
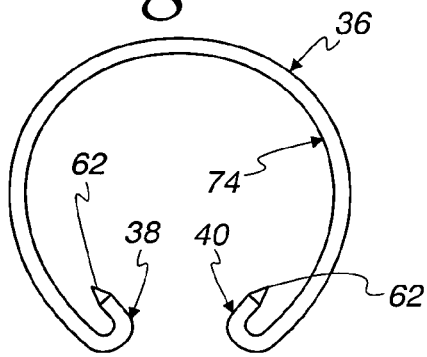
FIG. 9 is a view as in FIGS. 4 and 5 wherein the second item has been reconfigured to a more curved shape to be separately worn by a user.

As one alternative assembly method, the bowed shape of the second item 16 can be pre-selected, with the ends 38, 40 of the body 36 pre-bent into the "U" shape of FIGS. 4, 5 and 9. The second item 16 can then be slid over the rim/bill 14 from front to rear, with the rim/bill 14 being maintained in a shape substantially corresponding to the pre-shaped second item 16.

As a further alternative, the bottom surface 74 of the second item 16 can be laid against the surface 76 without any significant pre-forming of the second item 16. The second item 16 can then be bent along its length and the ends 38, 40 return bent to secure the second item 16 on the rim/bill 14.

In FIG. 4, one exemplary bowed shape for the second item 16 and rim/bill 14 is shown. In FIG. 5, the second item 16 is reshaped so that the bowing is more significant such that the rim/bill 14 has a narrower shape and a more pronounced curvature. FIGS. 4 and 5 represent just two different bowed shapes that might be selected. The second item 16 may be shaped in other manners. Aside from changing the bowing shape, the second item 16 may be used to produce other than a continuous curve between the side edges 24, 26 of the rim/bill 14, limited only by the bendability and dimensions of the second item 16.

Figure 10:
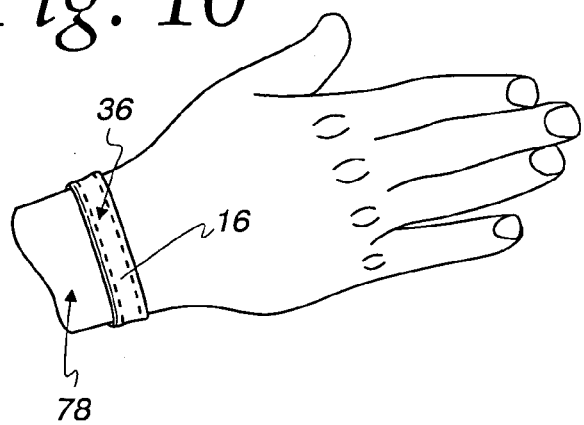
FIG. 10 is a fragmentary perspective view of a user's arm with the second item in the FIG. 9 configuration worn thereon in the form of a bracelet.

It is contemplated that the second item 16 can be worn by the user with the second item 16 separated from the headwear item 10. As one example, the second item 16 can be formed in the shape of a bracelet, as shown in FIGS. 9 and 10 on an arm 78 of a user.

Figure 11:
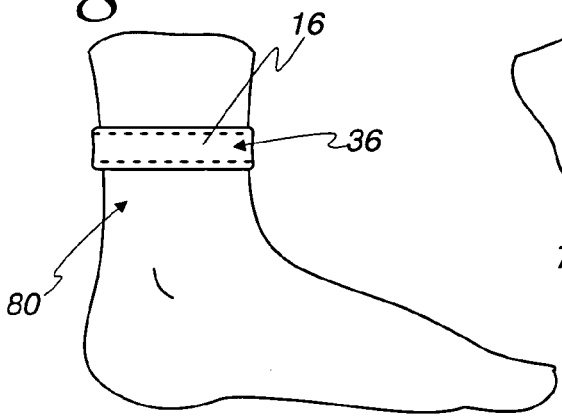
FIG. 11 is a fragmentary, elevation view of a user's leg with the second item in the FIG. 9 configuration worn thereon as an anklet.

In FIG. 11, the second item 16 is shown used as an anklet on a user's leg 80.

Figure 12:
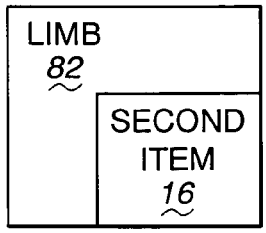
FIG. 12 is a schematic representation of the second item being worn on any limb of a user.

As shown schematically in FIG. 12, the second item 16 may be used apart from the headwear item 10 on any limb 82 on a wearer.

Figure 13:
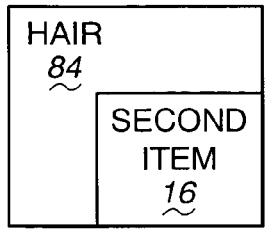
FIG. 13 is a schematic representation as in FIG. 12 wherein the second item is worn on the user's hair.

As a further alternative, as shown in FIG. 13, the second item 16 may be used as a band upon the user's hair 84 or otherwise attached to the hair.

Figure 14:
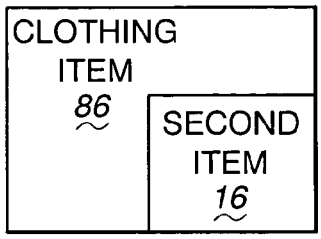
FIG. 14 is a schematic representation as in FIGS. 12 and 13 wherein the second item is worn on a clothing item on the user.

As a further alternative, as shown in FIG. 14, the second item 16 may be used to attach the same to a clothing item 86 on a user/wearer.

In one form, as shown in FIG. 1, information, shown generically at 88, is provided on the front of the crown 12. Additional information at 90 is provided on the web 48. The information 88, 90 may take any form, such as color, a logo, words, a depiction of a person, place or thing, etc. Generally, the information 88, 90 would relate to the same subject matter. As just one example, the information 88 may be a team logo, with the information 90 including the name of the team with which the logo is associated. Virtually any information as is commonly used on headwear is contemplated to be used on the headwear item 10 and the second item 16.

Figure 15:
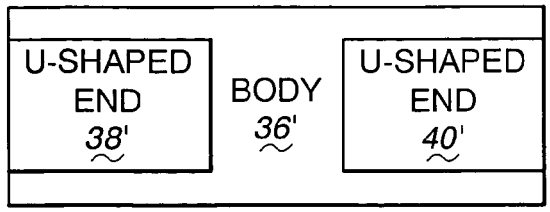
FIG. 15 is a schematic representation of the second item having a body with a fixed length between U-shaped ends.

As shown in FIG. 15, the invention contemplates that the body 36' may take virtually any form having U-shaped ends 38', 40' to engage the side edges 24, 26 of the rim/bill 14. As just one example, the body 36' may have a single, fixed length, reconfigurable element that may or may not be associated with a web corresponding to the web 48.

Figure 16:
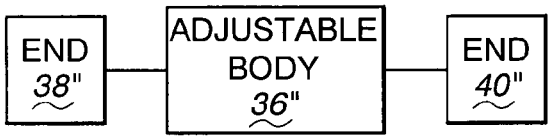
FIG. 16 is a schematic representation as in FIG. 15 of a modified form of the second item, wherein the second item has an adjustable length body between the ends thereof.

As an alternative to the fixed body length, as shown in FIG. 16, an adjustable body 36" may be used to alter the effective length between ends 38", 40".

As a further alternative, the structures shown in 15 and 16, rather than having a maintainable body shape, may be made from a chain with a fixed length or a variable length, with the ends thereof attachable at the side edges 24, 26 of a rim/bill 14.

As a still further variation, one or more wire elements can be used with a cloth layer that does not extend the full length of the wire(s).

Figure 2:
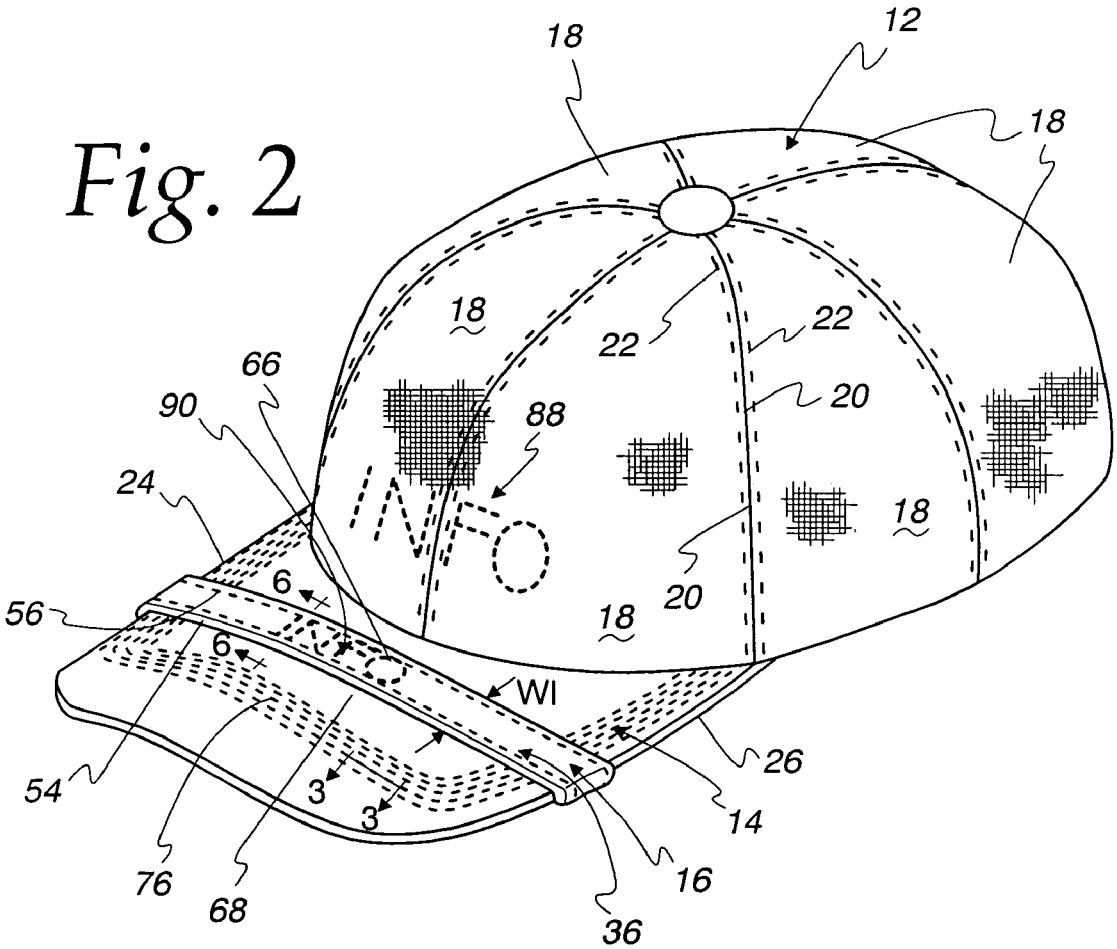
FIG. 2 is a perspective view of one form of headwear item, as in FIG. 1 and in the form of a baseball-style cap, with the second item attached to the rim/bill thereon.
Figure 17:
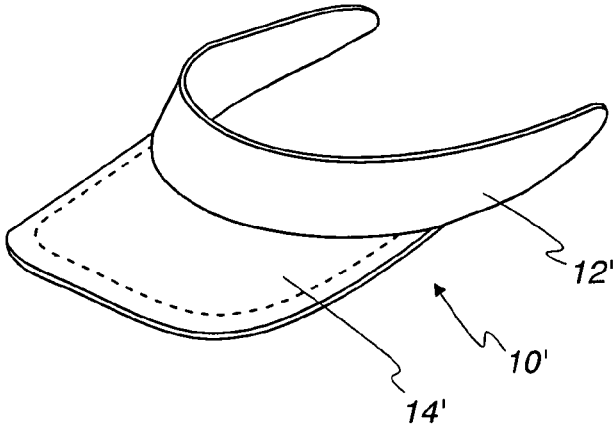
FIG. 17 is a view, as in FIG. 2, of a headwear item in the form of visor.

The invention is not limited to the particular headwear item shown in FIG. 2. As noted previously, virtually any headwear item is contemplated wherein there is a "crown" that maintains the headwear item on a wearer's head and a rim/bill projecting therefrom. For example, as shown in FIG. 17, a headwear item is shown at 10' in the form of a visor. The visor 10' has a crown 12' that extends partially around a wearer's head and has an open top. A rim/bill 14', constructed generally as the rim/bill 14, projects angularly away from the crown 12'. The second item 16 is attachable to the rim/bill 14' in the same manner as it is attachable to the rim/bill 14.

As noted previously, the invention contemplates virtually a limitless number of different constructions for the second item 16 that can be used with likewise virtually an unlimited number of different types of headwear items.

Figure 18:
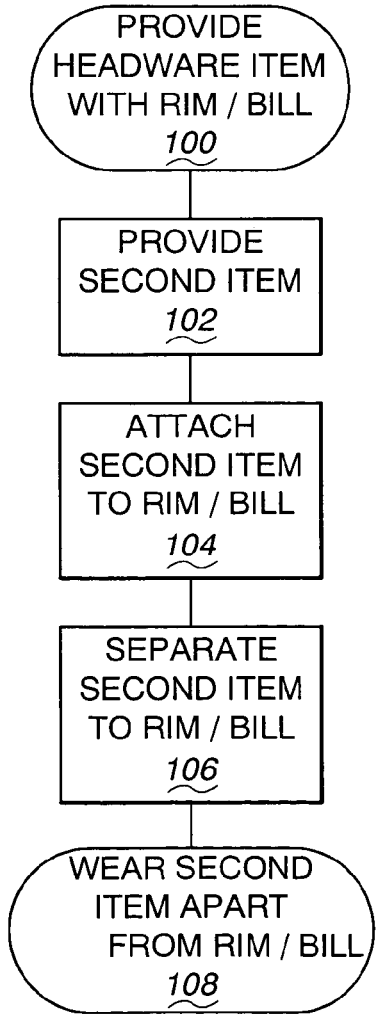
FIG. 18 is a flow diagram representation of a method of using wearable items, according to the present invention.

As shown in FIG. 18, the invention contemplates the provision of a headwear item with a rim/bill, as shown at block 100. As shown at block 102, a second item is provided and attached to the rim/bill, as shown at block 104. As shown at block 106, the second item is separated from the rim/bill and worn apart from the rim/bill, as shown at block 108. Thus, the invention is not limited in terms of the precise construction for the second item 16, the construction of the headwear item, or the manner of wearing the second item apart from the headwear item.

The foregoing disclosure of specific embodiments is intended to be illustrative of the broad concepts comprehended by the invention.

The invention claimed is:

1. A method of using wearable items, the method comprising the steps of:

providing a headwear item comprising a crown that engages a wearer's head and a rim/bill projecting angularly away from the crown;

providing a second item that can be selectively bent and maintained in a plurality of different shapes independently of the headwear item;

attaching the second item to the rim/bill so that the rim/bill is shaped to correspond to any of a plurality of the different shapes selected for the second item;

separating the second item from the rim/bill; and wearing the second item with the second item separated from the headwear item: a) by extending the second item around a wearer's limb; b) as a band on a wearer's head; or c) by attaching the second item to a wearer's hair.

2. The method of using wearable items according to claim 1 wherein the rim/bill has spaced side edges and the second item is in the form of a band with an elongate bendable element having spaced ends bent one each around the side edges of the rim/bill.

3. The method of using wearable items according to claim 1 wherein the rim/bill has spaced side edges and the step of attaching the second item to the rim/bill comprises engaging the rim/bill at both of the spaced side edges at the same time so that the second item causes the rim/bill to bow between the spaced side edges.

4. The method of using wearable items according to claim 3 wherein the step of attaching the second item to the rim/bill comprises changing a configuration of the second item to vary bowing of the rim/bill between the side edges.

5. The method of using wearable items according to claim 1 wherein the step of providing a headwear item comprises providing a headwear item with information that relates to a first subject matter and the step of providing a second item comprises providing a second item with information related to the first subject matter.

6. The method of using wearable items according to claim 1 wherein the step of providing a headwear item comprises providing a headwear item wherein the rim/bill has a core comprising expanded foam.

7. A method of using wearable items, the method comprising the steps of:

providing a headwear item comprising a crown that engages a wearer's head and a rim/bill projecting angularly away from the crown;

providing a second item;

attaching the second item to the rim/bill;

separating the second item from the rim/bill; and wearing the second item with the second item separated from the headwear item on at least one of: a) a wearer's limb or hair; or b) a clothing item worn by the wearer, wherein the step of providing a second item comprises providing an elongate second item that can be reconfigured and independently maintained in a plurality of different shapes, wherein the rim/bill has spaced side edges and the step of providing a second item comprises providing a second item comprising two elongate elements that each extends fully between and is bent around the spaced side edges of the rim/bill and a web spanning between the two elongate elements, the two elongate elements each being bendable and independently maintainable in a plurality of different shapes thereby to facilitate reconfiguration of the second item.

8. A method of using wearable items, the method comprising the steps of:

providing a headwear item that is designed to be worn by a user in a first manner and comprising a crown that engages a wearer's head and a rim/bill projecting angularly away from the crown;

providing a second item;

attaching the second item to the rim/bill;

reconfiguring the second item into a first curved shape to maintain a first shape of the rim/bill;

reconfigurating the second item into a second curved shape, that is different than the first curved shape to maintain a second shape of the rim/bill; and wearing the second item with the second item separated from the headwear item as a bracelet or anklet.

* * * * *

UNITED STATES PATENT AND TRADEMARK OFFICE

CERTIFICATE OF CORRECTION

PATENT NO. : 7,591,026 B2
APPLICATION NO. : 11/248535
DATED : September 22, 2009
INVENTOR(S) : Ronald Kronenberger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 605 days.

Signed and Sealed this

Twenty-first Day of September, 2010

David J. Kappos

David J. Kappos
*Director of the United States Patent and Trademark Office*